US005429533A

United States Patent [19]

Kobayashi et al.

[11] Patent Number: 5,429,533

[45] Date of Patent: Jul. 4, 1995

[54] CONTROL FOR WATERCRAFT

[75] Inventors: Noboru Kobayashi; Tomoyoshi Koyanagi; Keijiro Ikeda, all of Iwata, Japan

[73] Assignee: Yamaha Hatsudoki Kabushiki Kaisha, Iwata, Japan

[21] Appl. No.: 54,402

[22] Filed: Apr. 28, 1993

Related U.S. Application Data

[63] Continuation-in-part of Ser. No. 997,599, Dec. 28, 1992.

[51] Int. Cl.[6] ..... B63H 11/113

[52] U.S. Cl. ..... 440/42

[58] Field of Search ..... 440/38, 40, 41, 42, 440/43, 44, 47, 85, 86, 87, 88; 114/270

[56] References Cited

U.S. PATENT DOCUMENTS

| | | | |
|---|---|---|---|
| 3,137,266 | 6/1964 | Perrier et al. | 440/40 |
| 3,332,389 | 7/1967 | Van Veldhuizen et al. | 440/43 |
| 4,801,282 | 1/1989 | Ogawa et al. | 440/87 |
| 4,836,812 | 6/1989 | Griffiths | 440/63 |
| 5,145,426 | 9/1992 | Kobayashi et al. | 440/40 |

*Primary Examiner*—Stephen P. Avila

*Attorney, Agent, or Firm*—Knobbe, Martens, Olson & Bear

[57] ABSTRACT

A small watercraft powered by a pair of jet propulsion units each powered by a respective internal combustion engine. A single steering control controls simultaneously the steering nozzles for both jet propulsion units and a single throttle control controls the throttle for each of the engines.

10 Claims, 7 Drawing Sheets

CONTROL FOR WATERCRAFT

CROSS REFERENCE TO RELATED APPLICATION

This application is a continuation-in-part of our application entitled "Watercraft", Ser. No. 997,599, filed Dec. 28, 1992.

BACKGROUND OF THE INVENTION

This invention relates to a control for a watercraft and more particularly to an improved control for a watercraft powered by twin jet propulsion units.

As noted in our co-pending application, there are a number of advantages in providing a watercraft that is propelled by a pair of jet propulsion units. In addition, there are advantages if each jet propulsion unit is driven by its own respective internal combustion engine. The advantages of such arrangements are described in our co-pending application.

However, when a watercraft and particularly a small personal watercraft is powered by two internal combustion engines each driving its own respective jet propulsion unit, the controls for both the engine throttle and steering nozzles for the jet propulsion units can present certain difficulties. That is, if each engine and each jet propulsion unit steering nozzle has its own control, this places added burdens on the operator and can give rise to incorrect operation.

It is, therefore, a principal object to this invention to provide an improved control for a small watercraft powered by a pair of jet propulsion units.

It is a further object to this invention to provide an improved single control for the dual driving engines of a dual jet propelled watercraft.

It is a further object to this invention to provide an improved steering control for a jet propelled watercraft powered by a pair of jet propulsion units wherein both steering nozzles are controlled by a single control.

SUMMARY OF THE INVENTION

This invention is adapted to be embodied in a watercraft that is comprised of a hull and which hull mounts a pair of jet propulsion units for propelling the hull. Prime mover means are providing for driving the jet propulsion units and a single operator control controls simultaneously the operation of the jet propulsion units.

DETAILED DESCRIPTION OF THE PREFERRED EMBODIMENTS OF THE INVENTION

Figure 1:
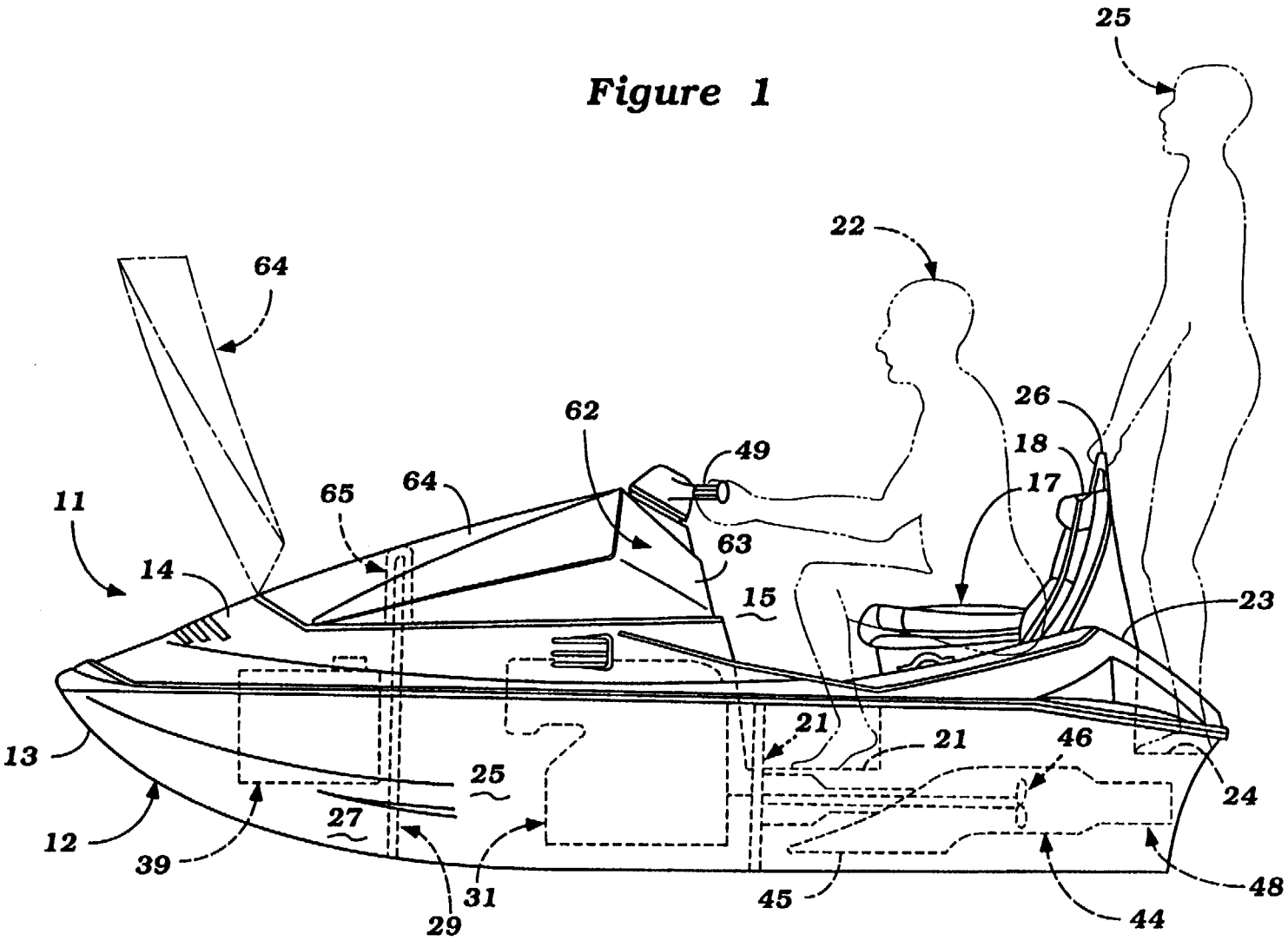
FIG. 1 is a side elevational view of a small watercraft constructed in accordance with an embodiment of the invention, with a rider and passenger shown in phantom and with a portion of the hatch cover closed shown in solid lines and open for engine access shown in phantom lines.
Figure 2:
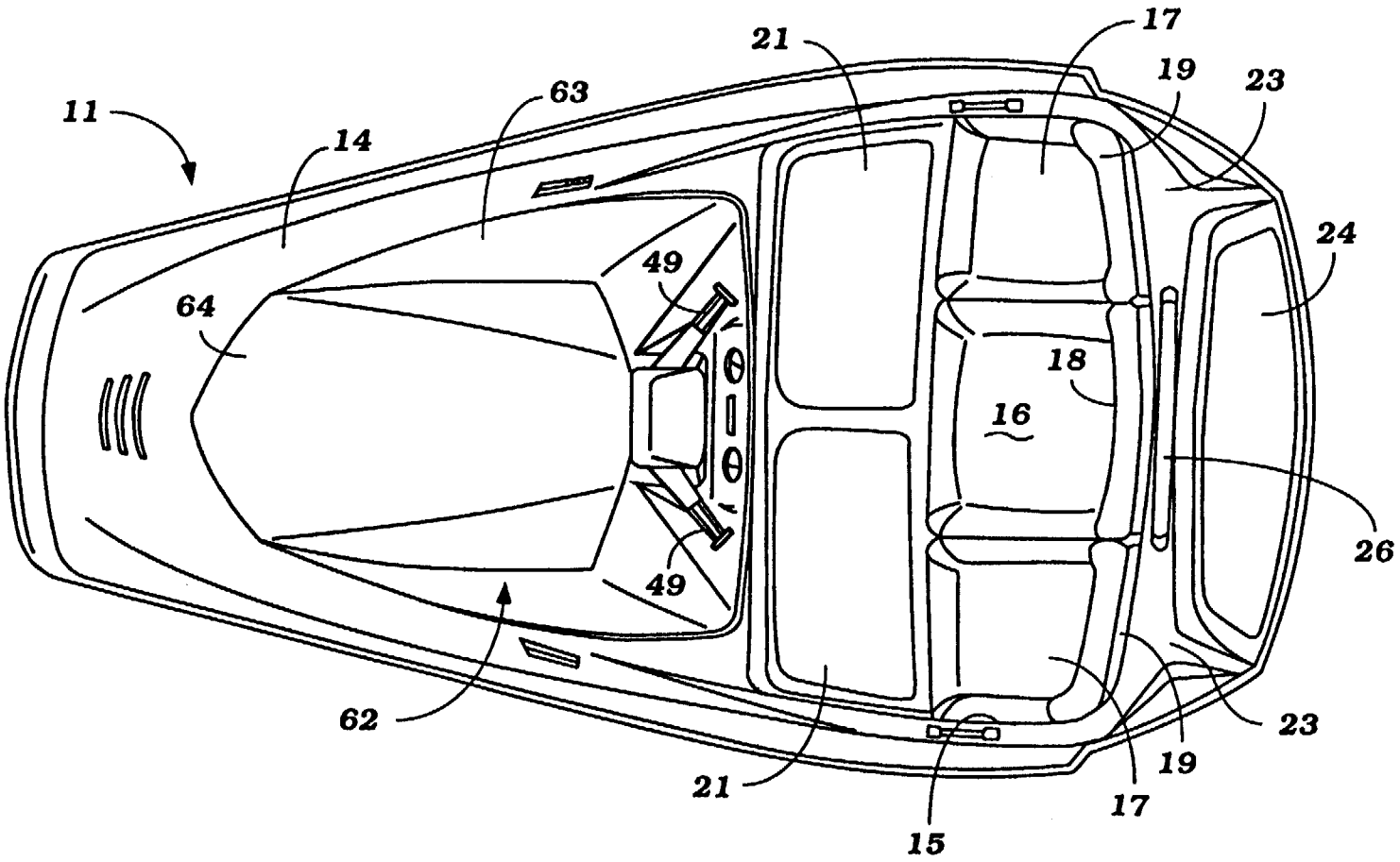
FIG. 2 is a top plan view of the watercraft.

Referring now in detail to the drawings and initially to FIGS. 1 and 2, a small watercraft constructed in accordance with an embodiment of the invention is identified generally by the reference numeral 11. The watercraft 11 is comprised of a hull, indicated generally by the reference numeral 12 and comprised of a lower hull portion 13 and an upper deck portion 14. The hull portions 13 and 14 are formed from a suitable material such as a molded fiberglass reinforced resin. The hull portion 13 and deck portion 14 are affixed to each other around their peripheral edges in any suitable manner.

A passenger compartment, indicated generally by the reference numeral 15 is provided to the rear of the hull 12 and accommodates a single transversely extending seat, which may be comprised of three portions consisting of a central rider's portion 16 and a pair of side, passenger portions 17. The seat portions 16 and 17 have respective seat backs 18 and 19. As may be seen, there are provided bolsters between the seats 16 and 17 so as to provide some lateral support. Thus, the seats 16 and 17 as illustrated comprise three side by side portions. It is to be understood, however, that the invention may be practiced with a single bench type seat. Foot areas 21 are provided forwardly of the seats 16 and 17 so that a rider, shown in phantom at 22 in FIG. 1, may sit upon the seat 16 with his feet in the foot area 21 in a normally seated fashion. In a like manner, passengers may sit in the seats 17 so as to also sit in a normally seated fashion.

A pair of raised rear gunnels 23 are formed on opposite sides of the rider's area 15 and to the rear of the seats 16 and 17. A deck area 24 extends between the rear of these gunnels 23 and provides a place where a passenger, indicated at 25 in FIG. 1, may stand. In addition, the rear deck area 24 permits access for entry to the watercraft 11 from the rear. So as to afford stabilization and assist in entry and also to permit the standing rider 25 to maintain his position, the seat back 18 of the rider's seat 16 is provided with a grab handle 26.

Figure 3:
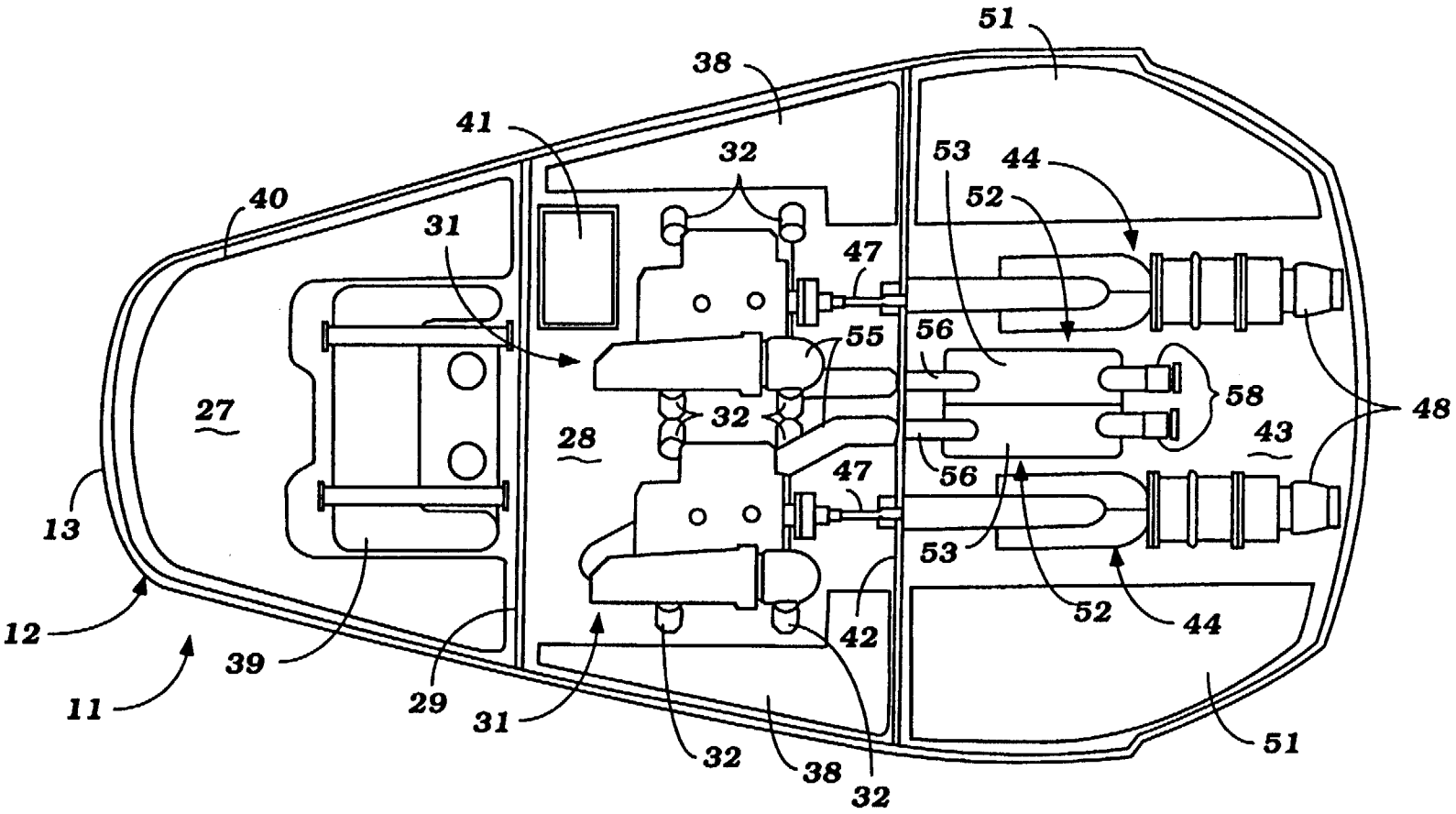
FIG. 3 is a top plan view of the watercraft, with the upper hull portion removed so as to show the location and orientation of the internal components.
Figure 4:
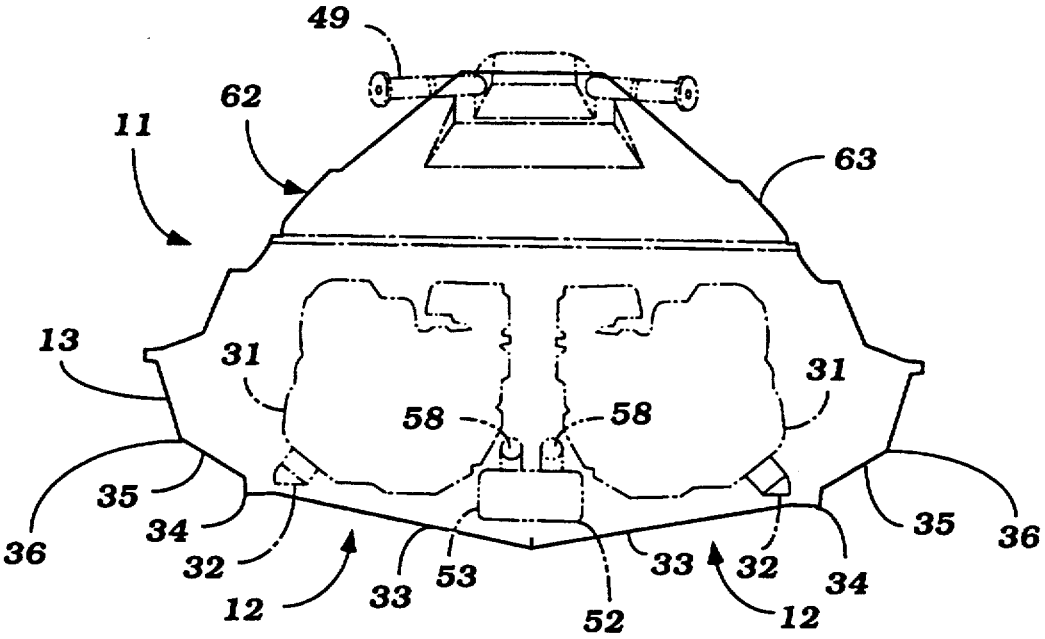
FIG. 4 is a rear elevational view of the watercraft.

Referring now additionally to FIGS. 3 and 4, the hull portion 13 is divided into a forward compartment 27 and a central engine compartment 28 by an internal vertically extending bulkhead 29. A pair of powering internal combustion engines 31 are disposed in side by side fashion within the engine compartment 28. The engines 31 may be of any known type and in the illustrated embodiment, are of the two cylinder, in-line, crankcase compression, two cycle internal combustion engine type. It is to be understood, however, that various other powering internal combustion engines may be employed. The engines 31 are mounted within the hull portion 13 on a plurality of resilient engine mounts 32.

As may be best seen in FIG. 4, the underside of the hull 12 has a generally V-bottom comprised of a pair of angularly disposed portions 33 which extend outwardly from the center of the hull 12 and which terminate at longitudinally extending stripes 34 which are disposed transversely outwardly of the engines 31 as clearly seen in this figure. This arrangement permits a fairly narrow hull which accommodates very quick and sharp maneuvering.

Figure 6:
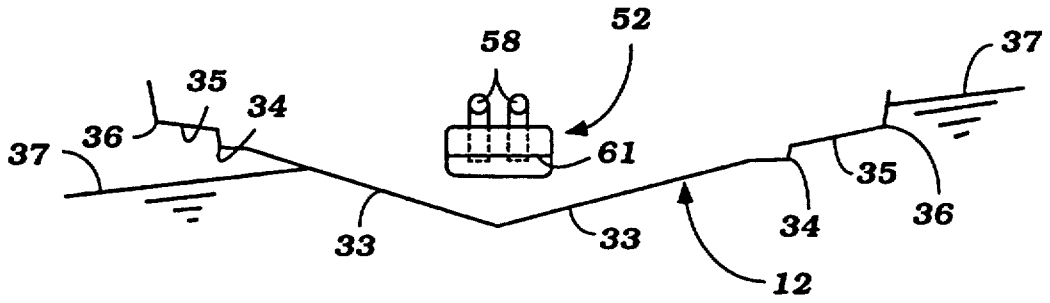
FIGS. 6 and 7 are partially schematic views showing the hull in the erect position (FIG. 6) and in the inverted position (FIG. 7) showing how the water trap operates.

Outwardly of the stripes 34, the hull 12 is provided with a pair of further inclined portions 35 which are inclined more steeply that the surfaces 33 and which terminate at further stripes 36. The portions 35 will become engaged in the body of water, as shown in FIG. 6 by the waterline 37, when maneuvering so as to afford stability as the watercraft 11 tends to lean or heel over. However, the portions 35 are normally out of the water when traveling straight ahead and hence will reduce drag and improve speed and maneuverability.

Referring again primarily to FIG. 3, a pair of floatation devices 38 such as foam, plastic blocks are positioned within the engine compartment 28 outwardly of the engines 31 so as to afford floatation.

A fuel tank, indicated generally by the reference numeral 39 is provided in the forward compartment 27 and is separated from the engine compartment 28 by the bulkhead 29. This provides obvious safety advantages and fuel is supplied from the fuel tank 39 to the engines 31 through appropriate conduits (not shown). A further buoyant block 40 is provided in the forward compartment 27 around the fuel tank 39 not only to protect the fuel tank 39 but also so as to afford further buoyancy.

A battery 41 may be positioned in the engine compartment 28 for offering a source of electrical power for accessories for the watercraft 11 and for starting. The battery 41 is charged by suitable magneto generators driven by the engines 31, in a well known manner.

A bulkhead 42 forms the rear portion of the engine compartment 28 and separates the engine compartment 28 from a tunnel area 43 in which a pair of jet propulsion units, indicated generally by the reference numeral 44 are supported in side by side fashion. Each jet propulsion unit 44 has a downwardly facing water inlet portion 45 through which water is drawn from the body of water in which the watercraft 11 is operated by means of an impeller 46 positioned in an impeller section and driven by the respective engine 31.

It should be noted that the engines 31 have their drive shafts 47 extending through the bulkhead 42 for driving the impellers 46 in a well known manner. The water thus pumped is then discharged through a discharge and steering nozzle 48 which is pivotally supported at the rear end of each jet propulsion unit 44 for powering the watercraft 11 and also for steering the watercraft 11. The steering nozzles 48 are connected in a manner to be described to a steering handle bar assembly 49 which is mounted to the front of the rider's seat 16 and by which the steering nozzles 48 may be steered in a well known manner. The mounting for the handle bar assembly 49 will be described latter. It should also be understood that the handle bar assembly 49 incorporates a throttle control for controlling the speed of the engines 31 and this construction will also be described later.

A further pair of buoyant masses, which may be formed from blocks of foam plastic and indicated generally by the reference numeral 51, are positioned transversely outwardly of the tunnel 43 and within the hull portion 42 as to afford further floatation for the hull 12.

Figure 5:
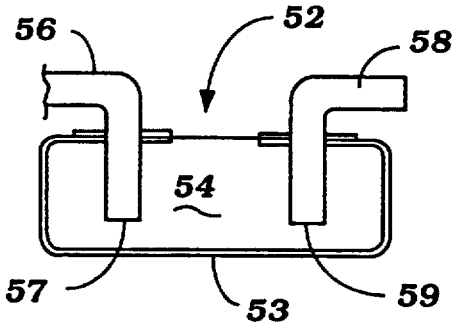
FIG. 5 is a longitudinal cross sectional view taken through the water trap device for the exhaust system of the powering internal combustion engines.
Figure 7:
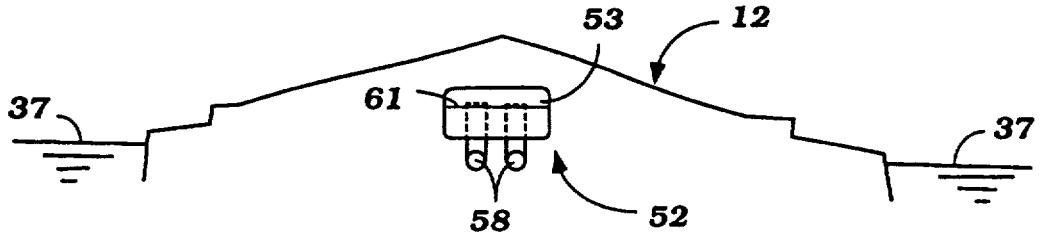

Positioned within the tunnel area 43 between the jet propulsion units 44 and generally along the longitudinal center line of the watercraft 11 are a pair of water trap devices 52 which, in the illustrated embodiment, are two units mounted together to form a common unit. These units 52 may be separate from each other but it is desirable to provide them on the longitudinal center line of the watercraft 11. Each water trap device 52 is comprised of an outer housing 53 that defines an internal chamber 54 (FIGS. 5 through 7).

As may be seen in FIG. 3, the engines 31 each have exhaust systems 55 which terminate in exhaust pipes 56 that extend through the bulkhead 42 and which have a right angle bend so as to enter the chambers 54. The lower end 57 of the exhaust pipes 56 are disposed at a spaced distance from the lower wall of the housing 53 so as to define an area wherein water may accumulate. As is typical with marine practice, the cooling water from the engines 31 may be discharged along with the exhaust gases from the exhaust pipes 56 into the water trap devices 52.

Exhaust discharge pipes 58 also have lower ends 59 positioned within the chambers 54 and discharge ends which extend into the tunnel area 43 and hence, the exhaust gases from the engines 31 and any cooling water discharge will pass through the water trap devices 52 and be discharged from the exhaust discharge pipes 58 into the atmosphere. The flow of the exhaust gases will insure that the coolant is also discharged back into the body of water in which the watercraft 11 is operating. However, when the engines 31 are stopped water will accumulate to a level as shown by the line 61 in the housings 53 and will partially submerge the lower ends of the exhaust pipes 56 and exhaust discharge pipes 58. However, if the watercraft 11 becomes inverted (FIG. 7) the pipe ends 57 and 59 will be positioned above the water level shown at 61 in this figure and water thus is trapped and prevented from flowing back into the engines 31 through their exhaust systems.

Referring now primarily to FIGS. 1, 2 and 4, the engine compartment 28 is accessible through a removable hatch assembly, indicated generally by the reference numeral 62. The hatch assembly 62 includes a main, larger hatch portion 63 which mounts the handle bar assembly 49. This hatch portion 63 when removed will offer free access to the engines 31 so that they can be removed completely from the hull 12. However, in order to permit ease of access to the engines 31 for servicing, such as changing spark plugs, etc., a smaller hatch portion 64 is pivotally connected to the hatch portion 63 so as to be moveable between a closed position as shown in solid lines in the figures and in open access position as shown in the phantom lines in FIG. 1. In this position, there is access to the engines 31 but the opening is not so large that the engines can be removed. Because of this, the main hatch cover 63 may be made more rigid since it need not be normally opened and closed for engine servicing while the openable portion 64 may be lighter in weight without reducing the strength of the overall assembly. Also the fuel tank 39 is accessible for filling when the portion 64 is opened.

The front bulkhead 29 is provided with a seal 65 which is engaged by the hatch portions 63 and 64 so as to permit sealing of the fuel tank 39 from the engines 31 when the hatch assembly is closed.

Figure 8:
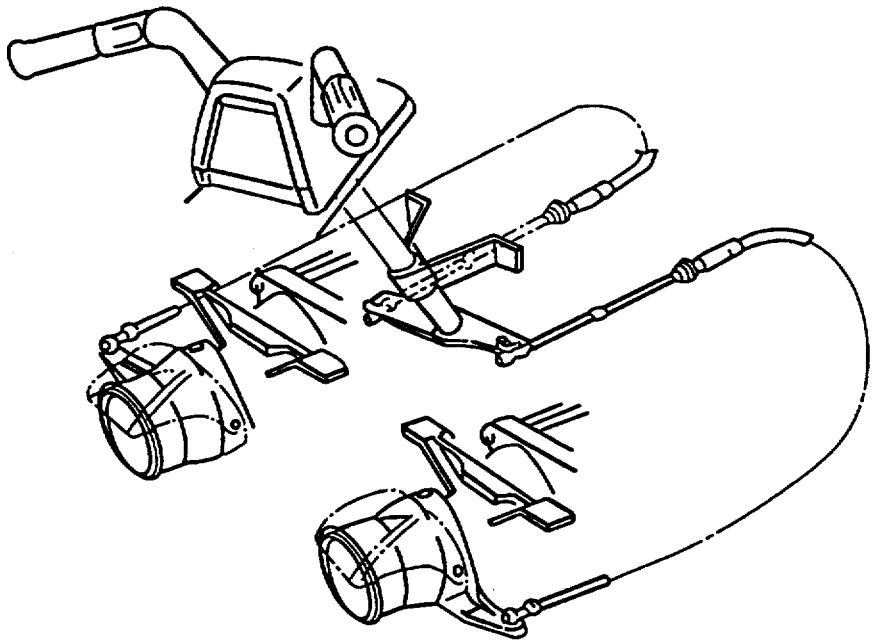
FIG. 8 is a perspective view showing the control for the steering nozzles of the two jet propulsion units from the single handle bar in accordance with one embodiment of the invention.

As has been noted, it is desirable to insure that the steering nozzles 48 of the jet propulsion units 44 are steered together in unison from a single control. One way in which this may be easily done is shown in FIG. 8 of the drawings, wherein the rear proportions of the jet propulsion units 44 are partially shown as is the support for the steering nozzles 48 for movement about their steering axis.

As may be seen, the handle bar assembly 49 is connected to a steering mast 66 which is journalled in the hull deck portion 14 on a supporting bracket 67. A steering arm 68 is connected to the lower end of the steering mast 66 and a pair of wire actuators 69 are each connected to respective ends of the steering arm 68. As may be seen, each wire actuator 69 includes a control wire portion 71 that has a connection 72 to the respective end of the steering arm. The wire portions 71 are contained within protective sheaths 73 which are anchored at any suitable manner.

Each steering nozzle 48 has an outwardly extending steering arm 74 formed integrally with it to which the outer ends of the wire portions 71 are connected by couplings 75. As a result of the construction, when the handle bar assembly 49 and steering mast 66 are steered in one direction or another, the steering nozzles 48 will be moved in the same direction.

Figure 9:
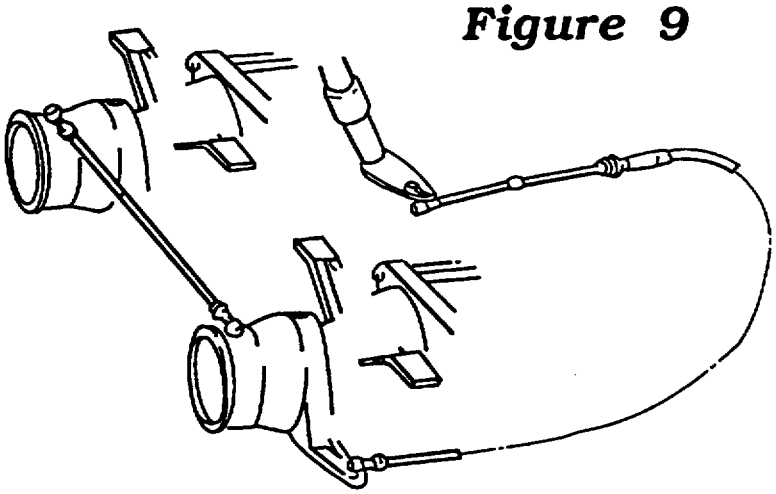
FIG. 9 is a partial perspective view, in part similar to FIG. 8 and shows another embodiment of the invention.

FIG. 9 shows another arrangement whereby both steering nozzles 48 may be steered in unison and in this embodiment, only a single control wire is required. In this embodiment, a steering arm 101 is provided at the lower end of the steering mast 66 and is connected to the wire element 102 of a wire actuator assembly 103 by a coupling 104. The wire actuator assembly 103 includes a protective sheath 105 that is anchored in any suitable manner.

The opposite end of the wire element 102 is connected to a steering arm 106 formed integrally with one of the steering nozzles 48 by a connector 107. Hence, one steering nozzle 48 is directly actuated by the handle bar assembly 49. A rigid link 108 has pivotal connections by means of couplings 109 to the upper portions of the steering nozzles 48 so as to link the steering nozzles 48 together for simultaneous movement. In this way, both steering nozzles 48 will be steered in the same sense by the single wire actuator 103.

Figure 10:
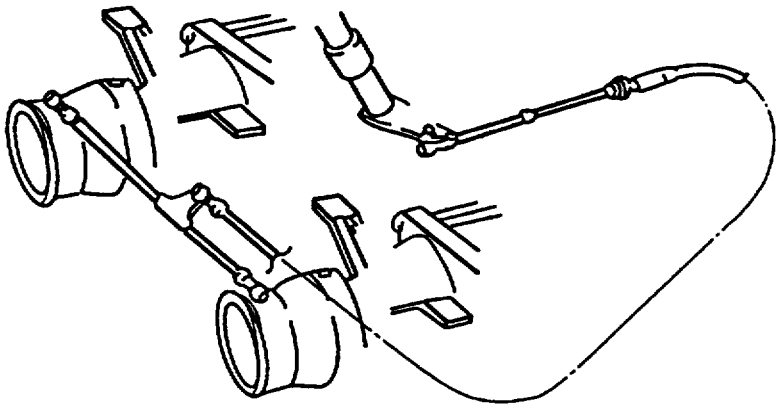
FIG. 10 is a partial perspective view, in part similar to FIGS. 8 and 9, and shows yet another embodiment of the invention.

FIG. 10 shows yet another embodiment of the invention wherein both steering nozzles 48 may be steered simultaneously. In this embodiment, like the embodiment of FIG. 9, a single steering arm 101 is connected to the lower end of the steering mast 66 and is connected to a single wire actuator 103. Because this portion of the construction is the same as the embodiment of FIG. 9, like components have been identified by like reference numerals and these components will not be described again.

In this embodiment, however, a single link 151 has pivotal connections 152 to the steering nozzles 48. This single link 152 also has affixed to it an intermediate control portion 153 to which the other end of the wire element 102 is connected by a coupler 154. Hence, in this embodiment the link 151 is directly operated and this effects simultaneous movement of the steering nozzles 48 in the same direction upon movement of the handle bar assembly 49 and steering mast 66.

Figure 11:
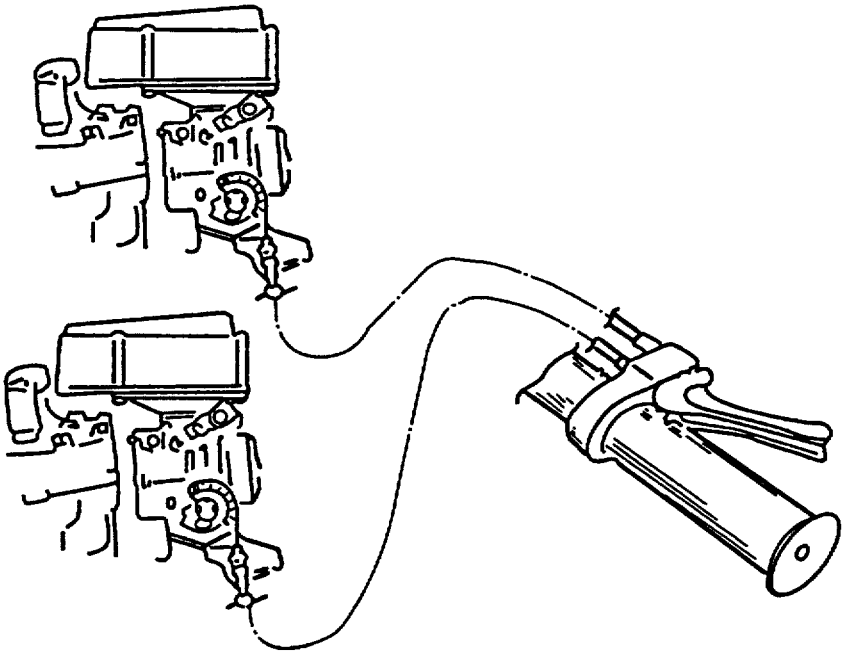
FIG. 11 is a partial perspective view showing the single throttle control for the two powering internal combustion engines.

It has also been noted that the engines 31 each have their speed controlled by a common throttle control and this construction is shown in FIG. 11. It should be noted that each engine 31 has one or more charge formers such as carburetors, indicated generally by the reference numeral 201 in this figure. These carburetors 201 have throttle valves that are fixed on throttle valve shafts 202, as is well known in this art. A single throttle control lever 203 is mounted by a mounting bracket 204 on the handle bar 49 adjacent one of the handle grips 205. This single throttle control lever 203 is connected to a pair of wire actuators 206 each of which comprises a wire actuator portion that is connected to the control lever 203 in a known manner and a surrounding protective sheath. The opposite ends of the wire actuators are connected by means of couplers 207 to a throttle control lever 208 that is affixed to the respective throttle valve shaft 202 of the respective carburetor 201. As a result, the single throttle lever 203 will provide simultaneous control of the engine speed of each engine 31.

It should be readily apparent from the foregoing description that the described embodiment of the invention is very effective in fulfilling the objects aforestated. Of course, the foregoing description is that of preferred embodiments of the invention and various changes and modifications may be made without departing from the spirit and scope of the invention, as defined by the appended claims.

We claim:

1. A watercraft comprised of a hull, a pair of jet propulsion units each comprising a respective water inlet, an impeller section containing an impeller for pumping water into said water inlet, a discharge nozzle though which the pumped water is discharged and a steering nozzle pivotal on said discharge nozzle for redirecting the water flow to effect steering mounted by said hull for propelling said hull, prime mover means for driving the impellers of said jet propulsion units, and a single steering control for controlling simultaneously the pivotal positions of said steering nozzles of said jet propulsion units.

2. A watercraft as set forth in claim 1 wherein the single operator control controls the steering nozzles by means including a flexible cable.

3. A watercraft as set forth in claim 2 wherein the single operator control is connected to each steering nozzle by a respective separate flexible cable.

4. A watercraft as set forth in claim 2 wherein the flexible cable connects a steering control to each of the steering nozzles through a linkage mechanism.

5. A watercraft as set forth in claim 4 wherein the linkage mechanism comprising a link pivotally connected to each steering nozzle and the flexible cable is connected to one of the steering nozzles.

6. A watercraft as set forth in claim 4 wherein the linkage mechanism comprises a link by which the steering nozzles are interconnected and the flexible cable directly actuates the link.

7. A watercraft as set forth in claim 1 wherein the prime mover means comprising internal combustion engine means and a single throttle control controls simultaneously said internal combustion engine means.

8. A watercraft as set forth in claim 7 wherein the internal combustion engine means comprising a pair of engines, one for each jet propulsion units.

9. A watercraft as set forth in claim 8 wherein the single throttle control controls a separate throttle of each engine.

10. A watercraft as set forth in claim 9 wherein the single throttle control controls a pair of wire actuators each connected to a respective one of the engine throttles.

* * * * *